US008757184B1

(12) United States Patent
Chen et al.

(10) Patent No.: US 8,757,184 B1
(45) Date of Patent: Jun. 24, 2014

(54) MULTI-FOLDED FULL-AUTOMATIC OPENING-CLOSING UMBRELLA

(76) Inventors: Wangshu-O Chen, Changhua County (TW); Mei-Ping Lin, Changhua County (TW); Chiung-Wen Yeh, Changhua County (TW); Hsuanyuan Chen, Changhua County (TW)

( * ) Notice: Subject to any disclaimer, the term of this patent is extended or adjusted under 35 U.S.C. 154(b) by 0 days.

(21) Appl. No.: 14/000,581

(22) PCT Filed: Jul. 1, 2011

(86) PCT No.: PCT/CN2011/076747

§ 371 (c)(1),
(2), (4) Date: Aug. 20, 2013

(87) PCT Pub. No.: WO2013/003992

PCT Pub. Date: Jan. 10, 2013

(51) Int. Cl.
*A45B 25/16* (2006.01)

(52) U.S. Cl.
USPC ..... 135/24; 135/20.3; 135/25.1

(58) Field of Classification Search
USPC ..... 135/16, 22, 24, 25.1, 25.33, 25.4, 28, 135/20.3
See application file for complete search history.

(56) References Cited

U.S. PATENT DOCUMENTS

| | | | | |
|---|---|---|---|---|
| 5,758,677 | A * | 6/1998 | Wang | 135/24 |
| 5,823,215 | A * | 10/1998 | Chou et al. | 135/24 |
| 6,145,522 | A * | 11/2000 | Ko | 135/24 |
| 6,543,464 | B1 * | 4/2003 | Grady, II | 135/22 |
| 6,817,371 | B2 * | 11/2004 | Lin et al. | 135/24 |
| 7,735,498 | B2 * | 6/2010 | You | 135/24 |
| 7,909,049 | B2 * | 3/2011 | Yang et al. | 135/20.3 |
| 8,365,747 | B1 * | 2/2013 | Su | 135/24 |
| 8,684,018 | B1 * | 4/2014 | Ni | 135/20.3 |
| 2005/0257817 | A1 * | 11/2005 | Kuo | 135/24 |
| 2011/0214704 | A1 * | 9/2011 | Chang | 135/23 |
| 2013/0306118 | A1 * | 11/2013 | Souma | 135/16 |

* cited by examiner

*Primary Examiner* — Winnie Yip

(57) ABSTRACT

A multi-folded full-automatic opening-closing umbrella comprises a frame, cloth, a middle rod set, an upper nest, a lower nest, a handle, an umbrella opening/closing transformation ratio mechanism disposed in the middle rod set, and an umbrella opening/closing driving mechanism disposed in the handle and the middle rod set. The umbrella opening/closing driving mechanism drives the middle sleeve of the middle rod set to move up and down relative to the inner sleeve, and linkage opening/closing functions of the sleeves of the middle rod set and the cloth are realized at the same time.

10 Claims, 9 Drawing Sheets c—c d–d

MULTI-FOLDED FULL-AUTOMATIC OPENING-CLOSING UMBRELLA

BACKGROUND OF THE INVENTION

1. Field of the Invention

The present invention relates to a multi-folded full-automatic opening-closing umbrella which can be controlled to open/close automatically.

2. Description of the Prior Art

In these days, the climate is constantly changing so people are used to take an umbrella along to prevent a heavy rain unexpectedly. But, the frame of a conventional umbrella has to be pushed to a specific position to unfold the umbrella. Once there is a sudden downpour, the user may be wet because he/she cannot unfold the umbrella quickly. Therefore, an improved umbrella is developed. The umbrella handle is provided with a button. The user just presses the button to unfold the umbrella automatically. But, this kind of umbrella doesn't have the function to fold the umbrella automatically. When the user gets in the car, he/she has to fold the umbrella with both hands. In such a short time, the user is always wet. This umbrella is inconvenient for use.

Chinese Utility Model Publication No. CN2476208Y published on Feb. 13, 2002 discloses a control device for an automatic umbrella. The working principle of this umbrella is that when the umbrella is unfolded, the button is pressed and the control device releases the middle rod of the umbrella. The middle rod is biased by the springs inside the middle rod to extend upward so as to unfold the umbrella. When the user wants to fold the umbrella, the button is pressed again for the control device to release the buckle inside the middle rod. The springs on the frame urges the umbrella to be folded. The buckle is pulled by the pull rope to the top of the middle rod. At this moment, the umbrella is not fully folded. The user has to push a portion of the umbrella toward the handle to shorten the middle rod. The springs are restored to energize, and the middle rod and the buckle are controlled by the control device in the handle again. Thus, the umbrella is folded completely.

The operation principle of the existing full-automatic umbrella is substantially identical to that of the aforesaid patent, such as Chinese Utility Model Application numbers 01217730.X, 01237609.4, 01262761.5, 03267824.X. The difference between them is the control device inside the handle to control the middle rod and the buckle.

Thus, the existing automatic umbrella can be unfolded automatically and folded semi-automatically. It cannot be completely folded to its original state to achieve a full automatic function. The umbrella is completely folded by applying a force. The present invention is to solve the problem how to fold/unfold the umbrella automatically by controlling the handle. Accordingly, the inventor of the present invention has devoted himself based on his many years of practical experiences to solve these problems.

SUMMARY OF THE INVENTION

The primary object of the present invention is to provide a multi-folded full-automatic umbrella to open/close the umbrella completely.

In order to achieve the aforesaid object, the multi-folded full-automatic opening-closing umbrella of the present invention comprises a frame having springs for folding the umbrella, an umbrella cloth secured on the frame, a middle rod set, an upper nest fixed to an upper end of the middle rod set, a lower nest fitted on the middle rod set, and a handle. The frame cooperates with the upper nest and the lower nest. The multi-folded full-automatic opening-closing umbrella further comprises an umbrella opening/closing transformation ratio mechanism disposed in the middle rod set and an umbrella opening/closing driving mechanism disposed in the handle and the middle rod set. The middle rod set having at least three sleeves which are respectively an outer sleeve, a middle sleeve and an inner sleeve from top to bottom in sequence. The upper end of the outer sleeve is provided with an outer sleeve plug, and the lower end of the outer sleeve is connected with an outer sleeve fixing ring cooperating with the middle sleeve. The upper end of the middle sleeve is provided with a middle sleeve plug having a middle sleeve pulley, and the lower end of the middle sleeve is connected with a middle sleeve fixing ring. The outer side of the middle sleeve fixing ring is provided with a middle sleeve fixing ring pulley. The lower end of the inner sleeve is fixed to the handle. The umbrella opening/closing transformation ratio mechanism comprises a lower nest pull rope, a middle sleeve pull rope, and an inner sleeve pull rope. One end of the lower nest pull rope is fixed to the middle sleeve plug. The other end of the lower nest pull rope passes through the outer sleeve and winds though the outer sleeve pulley to be fixed to the lower nest. One end of the middle sleeve pull rope is fixed to the upper end of the inner sleeve. The other end of the middle sleeve pull rope passes through the bottom of the middle sleeve and winds through the middle sleeve fixing ring pulley of the middle sleeve fixing ring and enters the middle sleeve to extend out of the upper end of the middle sleeve and enters the outer sleeve to extend out of the upper end of the outer sleeve to be fixed to the top of the outer sleeve. One end of the inner sleeve pull rope is fixed to the upper end of the inner sleeve. The other end of the inner sleeve pull rope passes through the middle sleeve and winds through the middle sleeve pulley of the middle sleeve plug and passes through between the middle sleeve and the outer sleeve to be fixed to the lower end of the outer sleeve. The umbrella opening/closing driving mechanism comprises a driving member connected with the middle sleeve plug and a power source to bring the driving member to move up and down relative to the inner sleeve. The power source is controlled by a button on the handle.

Preferably, the power source is a motor.

Preferably, the power source is a motor to bring a gear set to connect the driving member.

Preferably, the power source is a mechanical drive cooperating with a change gear seat to drive the driving member.

Preferably, the umbrella opening/closing driving mechanism comprises a driving pipe, a screw nut and a screw bolt. The driving pipe is fitted in the inner sleeve and connected with the power source. The driving pipe has a length corresponding to the inner sleeve. The screw net is fixed to the upper end of the driving pipe. The screw bolt is inserted in the screw nut. The screw nut is turned clockwise or counterclockwise to drive the screw bolt to move up and down relative to the screw nut. The upper end of the screw bolt is fixed on the middle sleeve plug.

Preferably, an outer sleeve plug is fixed inside the upper end of the outer sleeve. The outer sleeve plug has a central through hole. An outer sleeve pulley is provided at the upper part of the outer sleeve plug. The outer sleeve is formed with a notch corresponding in position to the outer sleeve pulley.

Preferably, the middle sleeve pulley on the middle sleeve is one or more.

Preferably, the middle sleeve fixing ring is an annular member. The upper part of the middle sleeve fixing ring is inserted into the middle sleeve. The lower end of the middle sleeve fixing ring is formed with a flange protruding out of the middle sleeve. One side of the flange is provided with the middle sleeve fixing ring pulley.

Preferably, the upper nest is fixed to the top of the outer sleeve. The lower part of the upper nest is fitted on the outer sleeve and formed with a lid groove corresponding in position to the notch of the outer sleeve.

Preferably, the middle sleeve pull rope and the inner sleeve pull rope are the same rope.

When the user wants to unfold the umbrella, the button of the handle is pressed to start the power source to output a power. The power source brings the driving member to move upward relative to the inner sleeve. The middle sleeve is pushed to unfold upward relative to the inner pipe. The distance between the middle sleeve plug and the upper end of the inner sleeve is lengthened. The inner sleeve pull rope pulls the outer sleeve fixing ring to move upward relative to the middle sleeve to supplement the change of the distance, namely, the outer sleeve is pushed to unfold relative to the middle sleeve. At this moment, the distance between the outer sleeve plug and the middle sleeve plug is lengthened. The lower nest pull rope pulls the lower nest to move upward relative to the outer sleeve to supplement the change of the distance. The lower nest is moved upward to unfold the frame. In this way, the umbrella is unfolded completely. When the user wants to fold the umbrella, the button of the handle is pressed to start the power source to output a power to turn reversely. The power source drives the driving member to move downward relative to the inner sleeve, and the middle sleeve is pushed by the middle plug connected with the middle sleeve plug to move downward relative to the inner pipe. The lower nest pull rope connected on the middle sleeve plug pulls the lower nest to move upward relative to the outer sleeve. The frame forced by the springs and the umbrella cloth is folded.

The present invention provides the umbrella opening/closing transformation ratio mechanism in the middle rod set of the umbrella to cooperate with the lower nest pull rope, the middle sleeve pull rope and the inner sleeve pull rope in the umbrella opening/closing transformation ratio mechanism and the upper nest and the lower nest of the middle rod set and to cooperate with the umbrella opening/closing driving mechanism in the handle to drive the middle sleeve of the middle rod set to move up and down relative to the inner sleeve. In this way, the sleeves of the middle rod set and the umbrella cloth can be unfolded or folded automatically so that the umbrella can be used conveniently and quickly.

DETAILED DESCRIPTION OF THE PREFERRED EMBODIMENTS

Figure 1:
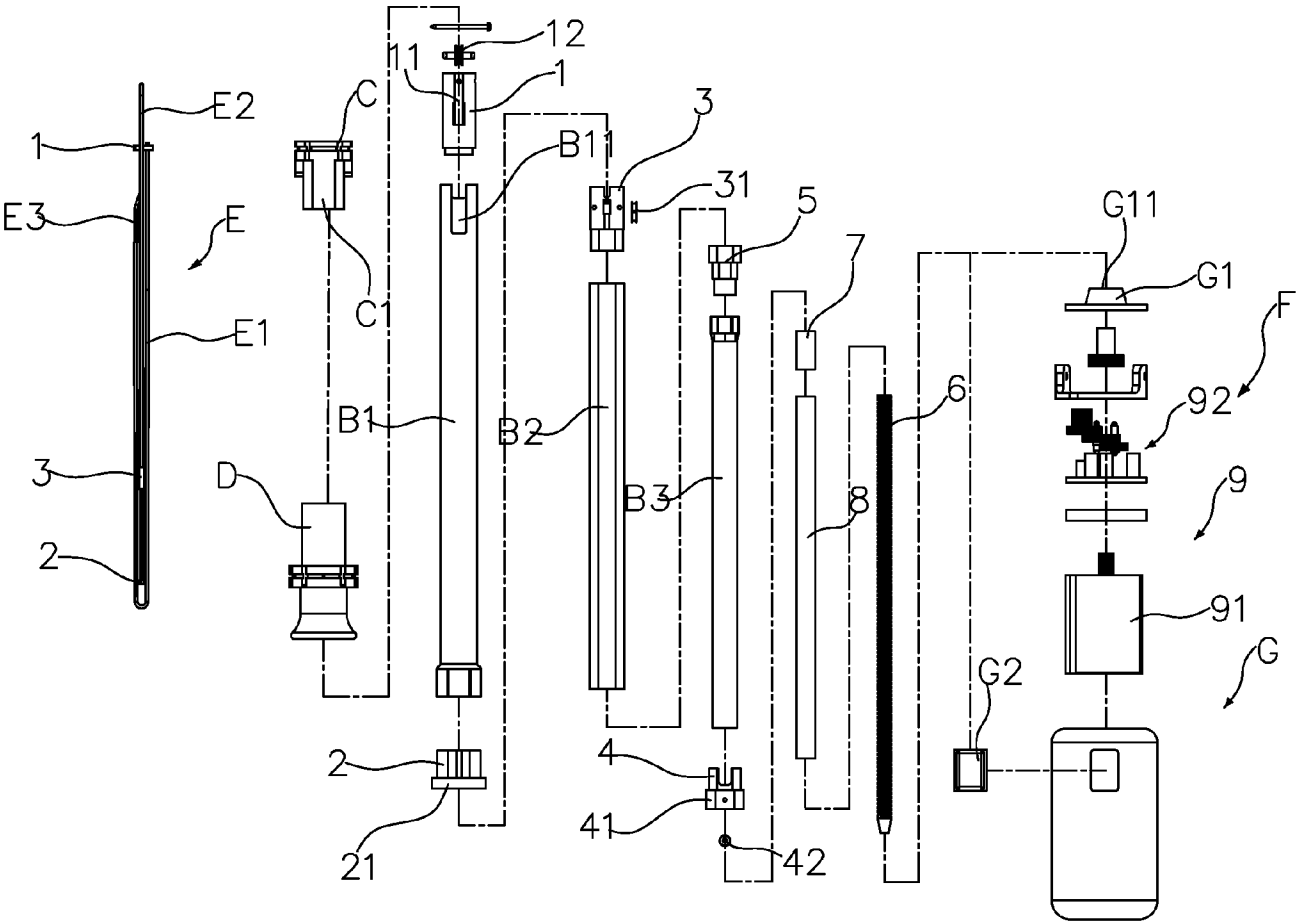
FIG. 1 is an exploded view according to a preferred embodiment of the present invention.
Figure 2:
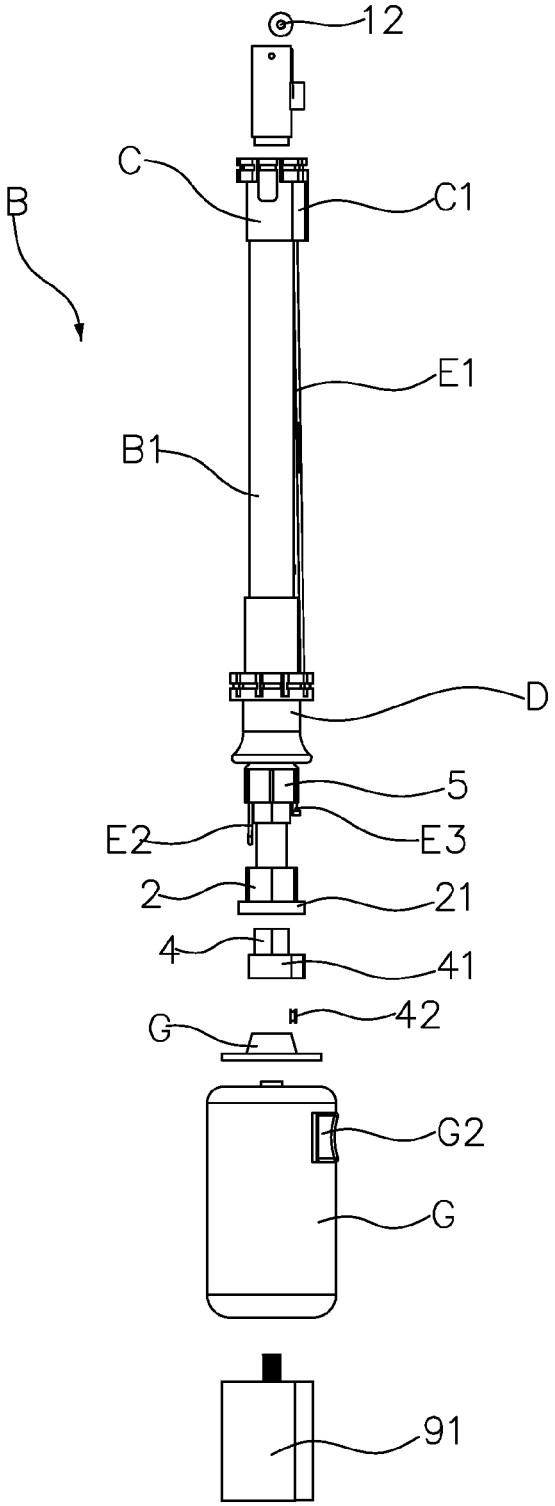
FIG. 2 is a partial exploded view according to the preferred embodiment of the present invention.
Figure 3:
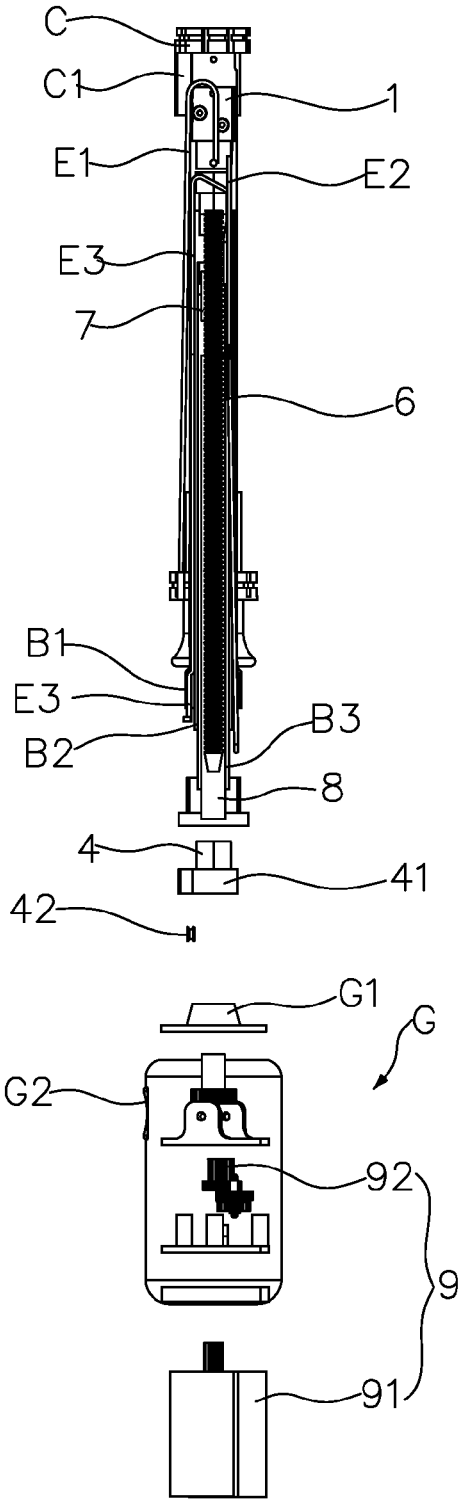
FIG. 3 is a partial sectional view according to the preferred embodiment of the present invention.

Embodiments of the present invention will now be described, by way of example only, with reference to the accompanying drawings.

As shown in FIG. 1 to FIG. 5, the present invention disclosures a multi-folded full-automatic opening-closing umbrella. In the embodiment, a three-section folded umbrella is as an example. The umbrella comprises a frame A, umbrella cloth (not shown in the drawings) secured on the frame A, a middle rod set B, an upper nest C, a lower nest D, an umbrella opening/closing transformation ratio mechanism E, an umbrella opening/closing driving mechanism F, and a handle G.

Figure 4:
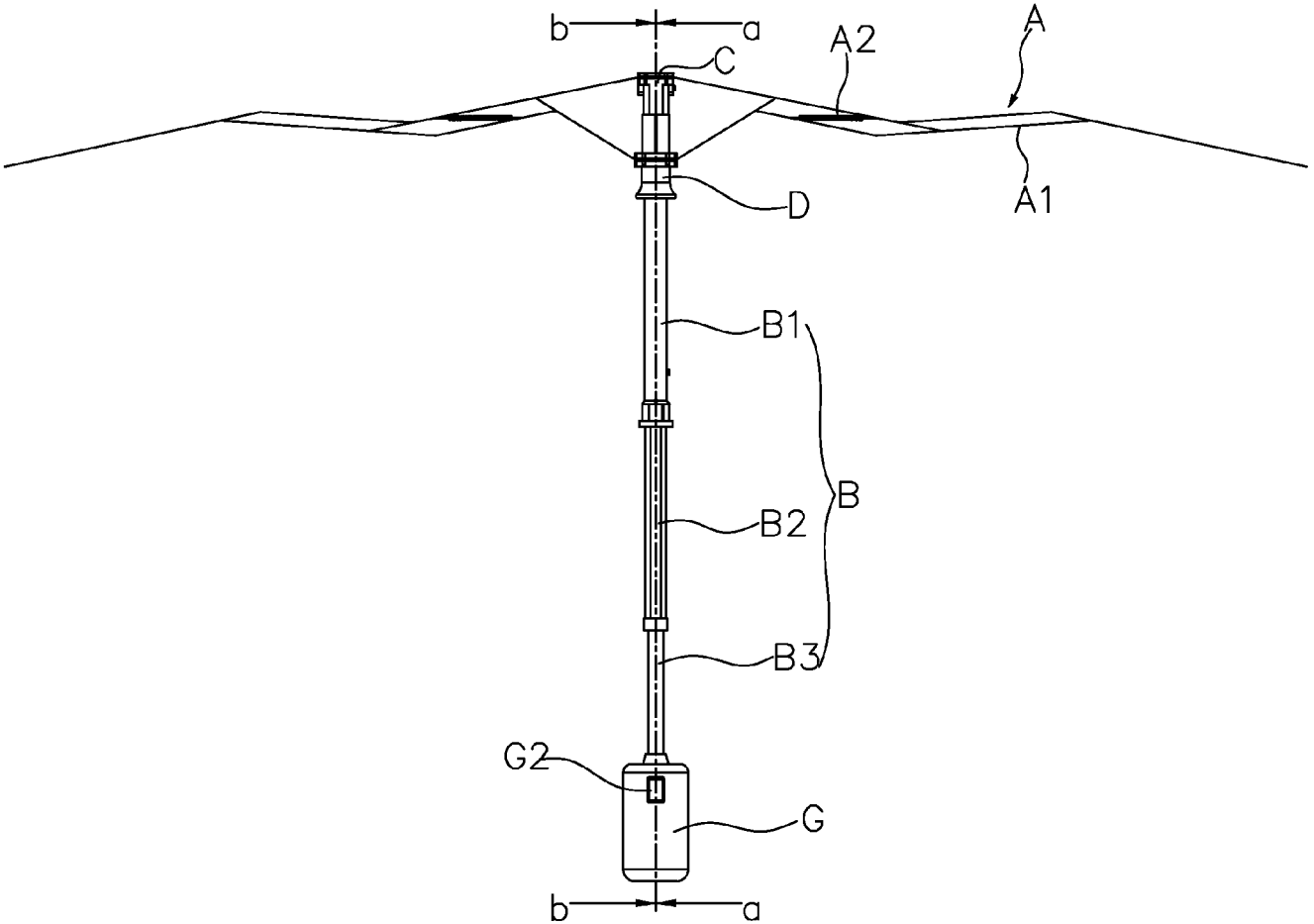
FIG. 4 is a schematic view showing the umbrella of the present invention in an unfolded state.
Figure 5:
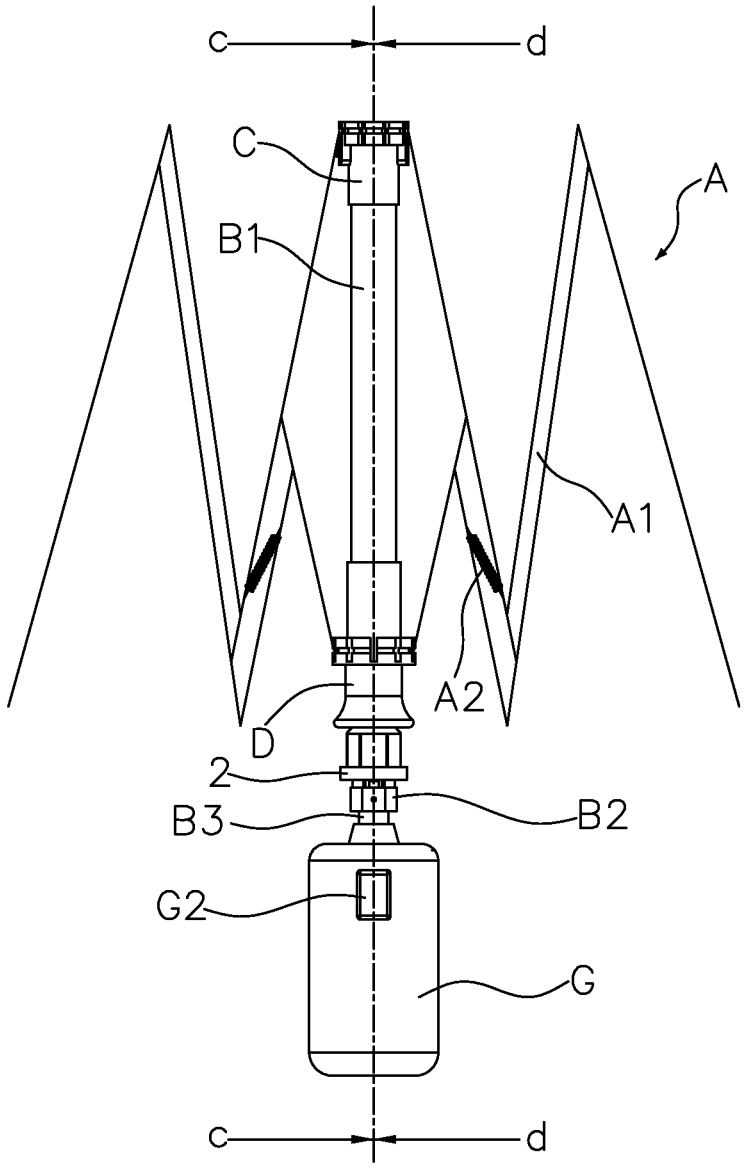
FIG. 5 is a schematic view showing the umbrella of the present invention in a folded state.

As shown in FIG. 4 and FIG. 5, the umbrella ribs A1 of the frame A cooperate with the corresponding upper nest C and the lower nest D, and each umbrella rib A1 is provided with a spring A2 for folding umbrella.

The middle rod set B has three sleeves, which are respectively an outer sleeve B1, a middle sleeve B2 and an inner sleeve B3 from top to bottom in sequence.

An outer sleeve plug 1 is fixed inside the upper end of the outer sleeve B1, and an outer sleeve fixing ring 2 is fixed to the lower end of the outer sleeve B1. The outer sleeve plug 1 has a central through hole 11. An outer sleeve pulley 12 is provided at the upper part of the outer sleeve plug 1. The outer sleeve B1 is formed with a notch B11 corresponding in position to the outer sleeve pulley 12 for passing of a lower nest pull rope E1. The outer sleeve fixing ring 2 is an annular member. The upper part of the outer sleeve fixing ring 2 is inserted into the outer sleeve B1, and the lower end of the outer sleeve fixing ring 2 is formed with a flange 21 protruding out of the outer sleeve B1.

A middle sleeve plug 3 is fixed to the upper end of the middle sleeve B2, and a middle sleeve fixing ring 4 is fixed to the lower end of the middle sleeve B2. The lower part of the middle sleeve plug 3 is inserted into the middle sleeve B2. The middle part of the middle sleeve plug 3 is provided with a middle sleeve pulley 31. The middle sleeve pulley 31 may be one or more. This embodiment has two pulleys. The middle sleeve fixing ring 4 is an annular member. The upper part of the middle sleeve fixing ring 4 is inserted into the middle sleeve B2, and the lower end of the middle sleeve fixing ring 4 is formed with a flange 41 protruding out of the middle sleeve B2. One side of the flange 41 is provided with a middle sleeve fixing ring pulley 42. The middle sleeve B2 is formed with a notch corresponding in position to the middle sleeve fixing ring pulley 42 for passing of a middle sleeve pull rope E2.

An inner sleeve plug 5 is fixed to the top end of the inner sleeve B3, and the lower end of the inner sleeve B3 is fixed to the handle G.

The aforesaid three sleeves uses their respective plugs, the middle sleeve plug 3 and the inner sleeve plug 5, to cooperate with their respective fixing rings, the outer sleeve fixing ring 2 and the middle sleeve fixing ring 4, to connect with each other, such that the middle rod set B is constituted to be folded and unfolded. There is no need for addition limitation of connection.

The upper nest C is secured to the top end of the outer sleeve B1. The lower part of the upper nest C is fitted on the outer sleeve B1 and formed with a lid groove C1 corresponding in position to the notch B11 of the outer sleeve B1 for passing of the lower nest pull rope E1.

The lower nest D is slidably fitted on the outer sleeve B1.

The umbrella opening/closing transformation ratio mechanism E comprises a lower nest pull rope E1, a middle sleeve pull rope E2 and an inner sleeve pull rope E3.

One end of the lower nest pull rope E1 is fixed to the top of the middle sleeve plug 3, and the other end of the lower nest pull rope E1 passes through the outer sleeve B1 and winds though the outer sleeve pulley 12 of the outer sleeve plug 1 to be fixed to the lower nest D.

One end of the middle sleeve pull rope E2 is fixed to the upper end of the inner sleeve B1, in this embodiment, fixed on the inner sleeve plug 5. The other end of the middle sleeve pull rope E2 passes through the notch B21 at the bottom of the middle sleeve B2, and winds through the middle sleeve fixing ring pulley 42 of the middle sleeve fixing ring 4, and enters the middle sleeve B2 to extend out of the upper end of the middle sleeve B2, and enters the outer sleeve B1 to extend out of the upper end of the outer sleeve B1 to be fixed on the outer sleeve plug 1.

One end of the inner sleeve pull rope E3 is fixed to the upper end of the inner sleeve B3, in this embodiment, fixed on the inner sleeve plug 5. The other end of the inner sleeve pull rope E3 passes through the middle sleeve B2, and winds through the middle sleeve pulley 31 of the middle sleeve plug 3, and enters the position between the middle sleeve B2 and the outer sleeve B1 and fixed to the lower end of the outer sleeve B1, in this embodiment, fixed to the flange 21 of the outer sleeve fixing ring 2.

Because one end of the middle sleeve pull rope E2 and one end of the inner sleeve pull rope E3 are fixed to the upper end of the inner sleeve, the middle sleeve pull rope E2 and the inner sleeve pull rope E3 can be the same rope with a knot fixed to the upper end of the inner sleeve.

The umbrella opening/closing driving mechanism F comprises a driving pipe 6, a screw nut 7, a screw bolt 8, and a power source 9 to drive the driving pipe 6. The power source 9 is a motor 91 to bring a gear set 92 to connect the driving pipe 6, alternatively, uses a mechanical drive cooperating with a change gear seat to drive the driving pipe 6. Certainly, it can be the rotation axle of the motor to cooperate with the driving pipe 6 directly. The driving pipe 6 is fitted in the inner sleeve B1, and has a length corresponding to the inner sleeve B1. The screw net 7 is fixed to the upper end of the driving pipe 6. The screw bolt 8 is inserted in the screw nut 7. The screw nut 7 is turned clockwise or counterclockwise to drive the screw bolt 8 to move up and down relative to the screw nut 7. The upper end of the screw bolt 8 is fixed on the middle sleeve plug 3.

The handle G is a cover to accommodate the power source 9. A lid G1 is fixed to the upper part of the handle G. The lid G1 has a central through hole G11 for connecting the driving pipe 6 and a rotation shaft 93 of the power source 93. The inner sleeve B3 of the middle rod set B is fixed on the lid G1. The lid of the handle G is provided with a button G2 to start the power source 9 to turn clockwise or counterclockwise.

Figure 5A:
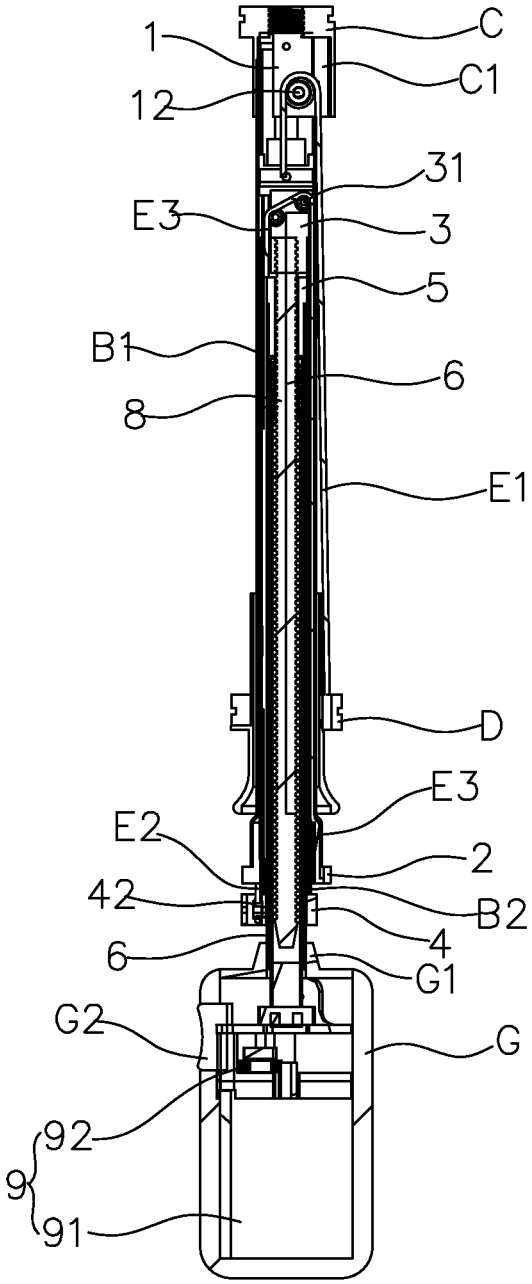
FIG. 5*a* is a sectional view taken along line a-a of FIG. 5.
Figure 5B:
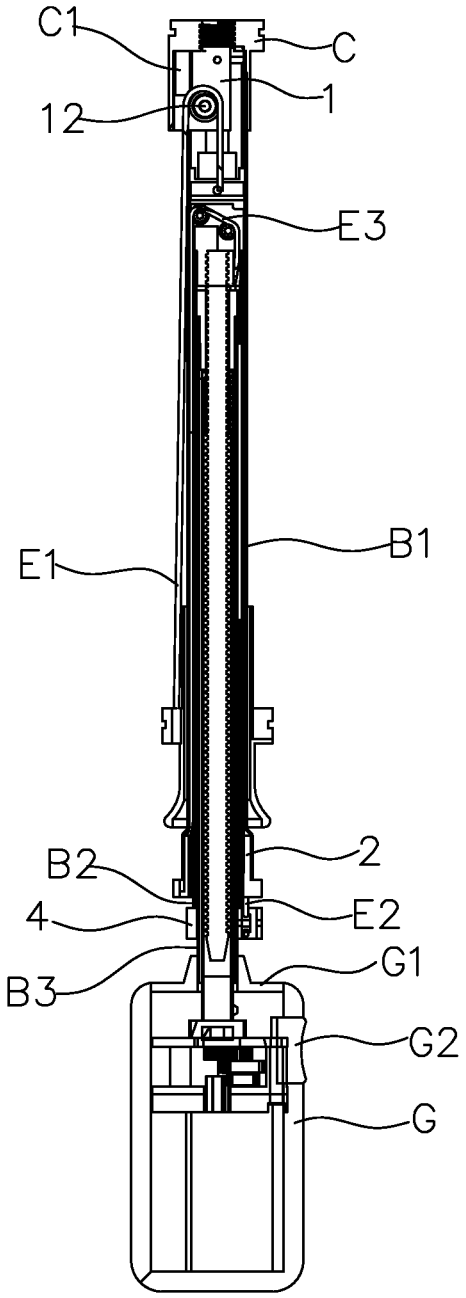
FIG. 5*b* is a sectional view taken along line b-b of FIG. 5.

As shown in FIG. 5, FIG. 5*a*, FIG. 5*b*, when the automatic umbrella is folded, the sleeves of the middle rod set B are retracted together, the screw bolt 8 is completely retracted in the driving pipe 6, and the lower nest D is located at the lower part of the outer sleeve B1.

Figure 4A:
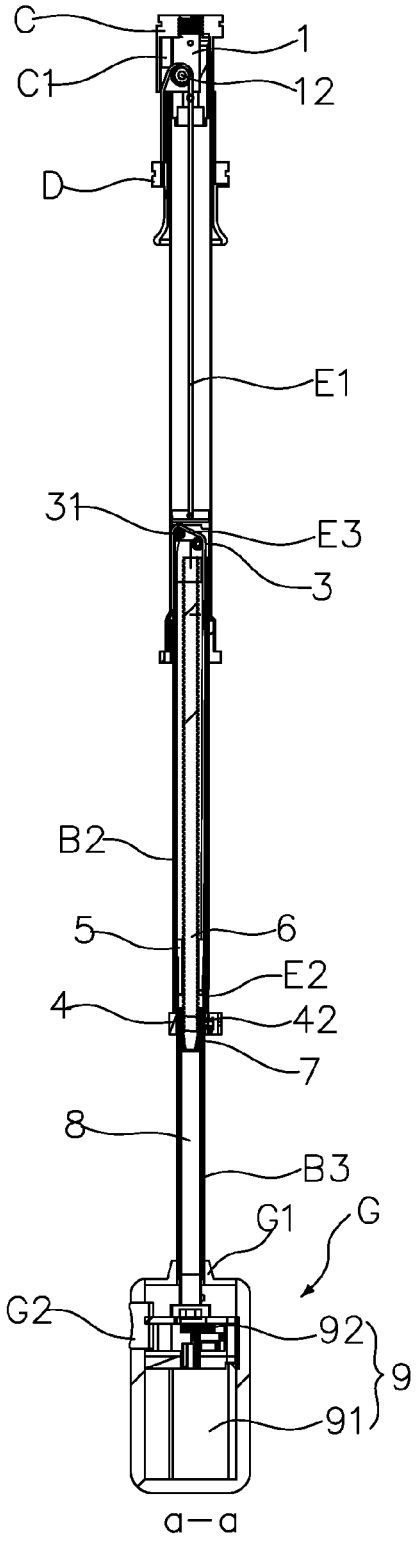
FIG. 4*a* is a sectional view taken along line a-a of FIG. 4.
Figure 4B:
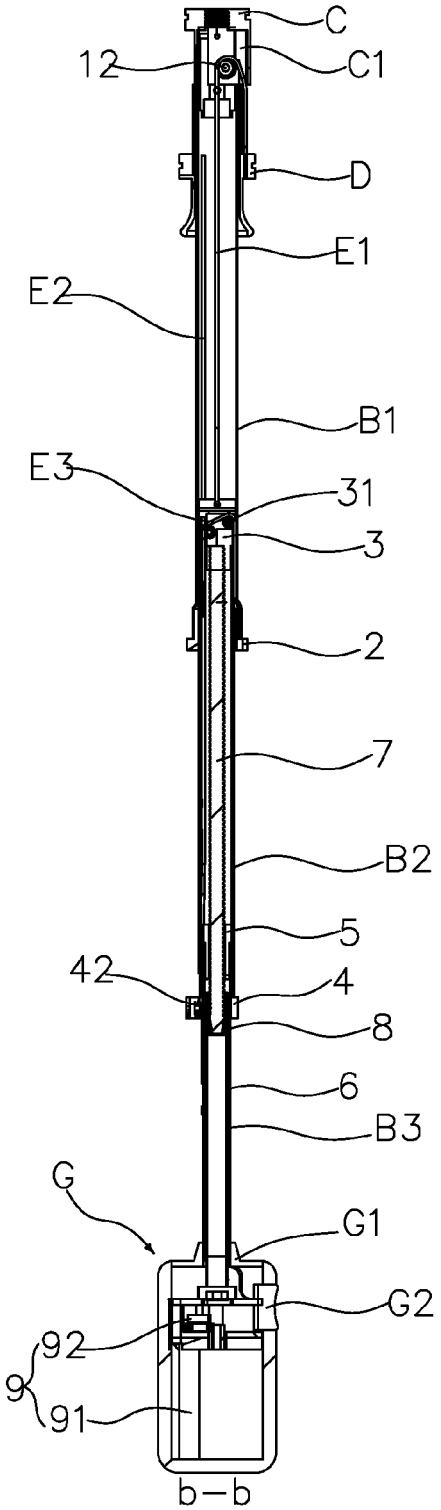
FIG. 4*b* is a sectional view taken along line b-b of FIG. 4.

As shown in FIG. 4, FIG. 4*a*, FIG. 4*b*, when the user wants to unfold the umbrella, the button G2 of the handle G is pressed to start the power source to output a power to turn clockwise. The power source 9 will drive the driving pipe 6 to turn. When the driving pipe 6 drives the nut 7 to turn, the nut 7 will push the screw bolt 8 to move upward relative to the inner sleeve B3, and the middle sleeve B2 is pushed to unfold upward relative to the inner pipe B3. When the middle sleeve B2 is moved upward, the distance between the middle sleeve plug 3 and the upper end of the inner sleeve B3 is lengthened. The inner sleeve pull rope E3 will pull the outer sleeve fixing ring 2 to move upward relative to the middle sleeve B2 to supplement the change of the distance, namely, the outer sleeve B1 is pushed to unfold relative to the middle sleeve. At this moment, the distance between the outer sleeve plug 1 and the middle sleeve plug 3 is lengthened. The lower nest pull rope E1 will pull the lower nest D to move upward relative to the outer sleeve B1 to supplement the change of the distance. The lower nest D is moved upward to unfold the frame A. In this way, the umbrella is unfolded completely. During the operation to unfold the umbrella, the inner sleeve pull rope E3 and the lower nest pull rope E1 are mainly to unfold the umbrella. The middle sleeve pull rope E2 is for the change of the shortened distance between the middle sleeve fixing ring 4 and the inner sleeve B3 as well as the lengthened distance between the outer sleeve plug 1 and the upper end of the inner sleeve B3.

As shown in FIG. 5, FIG. 5*a*, FIG. 5*b*, when the user wants to fold the umbrella, the button G2 of the handle G is pressed to start the power source to output a power to turn reversely. The power source 9 will drive the driving pipe 6 to turn reversely. When the driving pipe 6 drives the nut 7 to turn, the nut 7 will push the screw bolt 8 to move downward relative to the inner sleeve B3, and the middle sleeve B2 is pushed by the middle plug 3 connected with the screw bolt 8 to move downward relative to the inner pipe B3. The lower nest pull rope E1 connected on the middle sleeve plug 3 will pull the lower nest D to move upward relative to the outer sleeve B1. The frame A forced by the springs A1 and the umbrella cloth is folded. At this moment, the distance between the middle sleeve fixing ring 4 and the upper end of the inner sleeve B3 is lengthened. The middle sleeve pull rope E2 will pull the outer sleeve plug 1 to bring the outer sleeve B1 to move downward relative to the middle sleeve B2. In this way, the umbrella is folded completely. During the operation to fold the umbrella, the middle sleeve pull rope E2 and the lower nest pull rope E1 are mainly to fold the umbrella. The inner sleeve pull rope E3 is for the change of the lengthened distance between the outer sleeve fixing ring 2 and the middle sleeve plug 3 as well as the shortened distance between the middle sleeve plug 3 and the upper end of the inner sleeve B3.

Certainly, the umbrella opening/closing driving mechanism F is not limited to the aforesaid structure. As long as the power source 9 can bring the inner sleeve B3 to move up and down and to link the connected middle sleeve plug 3 to drive the function to open/close the umbrella.

To sum up the aforesaid structure, the present invention provides the umbrella opening/closing transformation ratio mechanism E in the middle rod set B of the umbrella to cooperate with the lower nest pull rope E1, the middle sleeve pull rope E2 and the inner sleeve pull rope E3 in the umbrella opening/closing transformation ratio mechanism E and the upper nest C and the lower nest D of the middle rod set B and to cooperate with the umbrella opening/closing driving mechanism F in the handle G to drive the middle sleeve B2 of the middle rod set B to move up and down relative to the inner sleeve B3. In this way, the sleeves of the middle rod set B and the umbrella cloth can be unfolded or folded automatically so that the umbrella can be used conveniently and quickly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-folded full-automatic opening-closing umbrella, comprising a frame having springs for folding the umbrella, an umbrella cloth secured on the frame, a middle rod set, an upper nest fixed to an upper end of the middle rod set, a lower nest fitted on the middle rod set and a handle, the frame cooperating with the upper nest and the lower nest; characterized by:

the multi-folded full-automatic opening-closing umbrella further comprising an umbrella opening/closing transformation ratio mechanism disposed in the middle rod set and an umbrella opening/closing driving mechanism disposed in the handle and the middle rod set; the middle rod set having at least three sleeves which are respectively an outer sleeve, a middle sleeve and an inner sleeve from top to bottom in sequence; an upper end of the outer sleeve being provided with an outer sleeve plug, a lower end of the outer sleeve being connected with an outer sleeve fixing ring cooperating with the middle sleeve; an upper end of the middle sleeve being provided with a middle sleeve plug having a middle sleeve pulley, a lower end of the middle sleeve being connected with a middle sleeve fixing ring, an outer side of the middle sleeve fixing ring being provided with a middle sleeve fixing ring pulley; a lower end of the inner sleeve being fixed to the handle; the umbrella opening/closing transformation ratio mechanism comprising a lower nest pull rope, a middle sleeve pull rope and an inner sleeve pull rope; one end of the lower nest pull rope being fixed to the middle sleeve plug, another end of the lower nest pull rope passing through the outer sleeve and winding though the outer sleeve pulley to be fixed to the lower nest; one end of the middle sleeve pull rope being fixed to the upper end of the inner sleeve, another end of the middle sleeve pull rope passing through the bottom of the middle sleeve and winding through the middle sleeve fixing ring pulley of the middle sleeve fixing ring and entering the middle sleeve to extend out of the upper end of the middle sleeve and entering the outer sleeve to extend out of the upper end of the outer sleeve to be fixed to the top of the outer sleeve; one end of the inner sleeve pull rope being fixed to the upper end of the inner sleeve, another end of the inner sleeve pull rope passing through the middle sleeve and winding through the middle sleeve pulley of the middle sleeve plug and passing through between the middle sleeve and the outer sleeve to be fixed to the lower end of the outer sleeve; the umbrella opening/closing driving mechanism comprising a driving member connected with the middle sleeve plug and a power source to bring the driving member to move up and down relative to the inner sleeve, the power source being controlled by a button on the handle.

2. The multi-folded full-automatic opening-closing umbrella as claimed in claim 1, wherein the power source is a motor.

3. The multi-folded full-automatic opening-closing umbrella as claimed in claim 1, wherein the power source is a motor to bring a gear set to connect the driving member.

4. The multi-folded full-automatic opening-closing umbrella as claimed in claim 1, wherein the power source is a mechanical drive cooperating with a change gear seat to drive the driving member.

5. The multi-folded full-automatic opening-closing umbrella as claimed in claim 1, 2, 3 or 4, wherein the umbrella opening/closing driving mechanism comprises a driving pipe, a screw nut and a screw bolt, the driving pipe being fitted in the inner sleeve and connected with the power source, the driving pipe having a length corresponding to the inner sleeve, the screw net being fixed to an upper end of the driving pipe, the screw bolt being inserted in the screw nut, the screw nut being turned clockwise or counterclockwise to drive the screw bolt to move up and down relative to the screw nut, an upper end of the screw bolt being fixed on the middle sleeve plug.

6. The multi-folded full-automatic opening-closing umbrella as claimed in claim 1, wherein an outer sleeve plug is fixed inside the upper end of the outer sleeve, the outer sleeve plug having a central through hole, an outer sleeve pulley being provided at an upper part of the outer sleeve plug, the outer sleeve being formed with a notch corresponding in position to the outer sleeve pulley.

7. The multi-folded full-automatic opening-closing umbrella as claimed in claim 1, wherein the middle sleeve pulley on the middle sleeve is one or more.

8. The multi-folded full-automatic opening-closing umbrella as claimed in claim 1, wherein the middle sleeve fixing ring is an annular member, an upper part of the middle sleeve fixing ring being inserted into the middle sleeve, a lower end of the middle sleeve fixing ring being formed with a flange protruding out of the middle sleeve, one side of the flange being provided with the middle sleeve fixing ring pulley.

9. The multi-folded full-automatic opening-closing umbrella as claimed in claim 6, wherein the upper nest is fixed to the top of the outer sleeve, a lower part of the upper nest being fitted on the outer sleeve and formed with a lid groove corresponding in position to the notch of the outer sleeve.

10. The multi-folded full-automatic opening-closing umbrella as claimed in claim 1, wherein the middle sleeve pull rope and the inner sleeve pull rope are the same rope.

* * * * *